US006366211B1

(12) United States Patent
Parker

(10) Patent No.: US 6,366,211 B1
(45) Date of Patent: Apr. 2, 2002

(54) REMOTE RECOVERY ARRANGEMENT FOR ALARM SYSTEM

(75) Inventor: James Parker, Thornhill (CA)

(73) Assignee: Digital Security Controls Ltd., Concord (CA)

( * ) Notice: Subject to any disclaimer, the term of this patent is extended or adjusted under 35 U.S.C. 154(b) by 0 days.

(21) Appl. No.: 09/570,813

(22) Filed: May 15, 2000

(51) Int. Cl.[7] ..... G08B 23/00

(52) U.S. Cl. ..... 340/693.2; 340/506; 340/533; 379/39

(58) Field of Search ..... 340/506, 541, 340/693.2, 5.8, 531, 533, 538; 379/37, 39, 40

(56) References Cited

U.S. PATENT DOCUMENTS 4,893,324 A * 1/1990 Scown ..... 379/40
4,908,604 A * 3/1990 Jacob ..... 340/531 X
5,587,701 A * 12/1996 Hess ..... 340/538 X
5,955,946 A * 9/1999 Beheshti et al. ..... 340/506
6,054,920 A * 4/2000 Smith et al. ..... 340/506

* cited by examiner

*Primary Examiner*—Thomas Mullen

(57) ABSTRACT

A security alarm system cooperates with a remote monitoring station to improve the reliability of the alarm system. The alarm system includes a control panel which during communications with the remote monitoring station, receives information used for the operation of the system and preferably provides information for storage by the remote monitoring station which information is recovered by the control panel if necessary.

12 Claims, 5 Drawing Sheets

REMOTE RECOVERY ARRANGEMENT FOR ALARM SYSTEM

BACKGROUND OF THE INVENTION

The present invention relates to security systems having an alarm control panel that communicates with a remote recovery arrangement to recover data in the event of a complete loss of power to the system.

Security alarm systems typically include an alarm control panel which reports, among other functions, to a central monitoring station. The most common communication method is to use conventional telephone communication. The security system for protecting a particular premise or area has a control panel which receives signals from a series of sensors which monitor and identify changes in conditions in the monitored area. Based on the output signals of the sensors, alarm conditions are identified and reported to the central monitoring station.

Security systems typically include a battery backup power source that maintains the security system for a period of time in the event of a power outage. Unfortunately, the power backup is only designed to maintain the system for a certain period of time and eventually the system will cease to operate.

The battery backup power source maintains the information stored in volatile memory of the alarm control panel such that information entered to customize the security system for a particular application is maintained. The alarm control panel typically includes non-volatile memory which is unaffected by power outages. In contrast, when power completely fails to volatile memory, the information contained in the memory is lost. Volatile memory contains system parameters which are entered by the system installer or the end user and allow the system to be customized for the particular application. To overcome certain difficulties, the volatile system parameters are programmed with a default value at the time of manufacture and these values are then adjusted by the installer or end user to suit the specific needs of the customer or installation site. The system, when re-powered after complete failure of power, uses these default values and as such substantial information is lost.

If the default values are used, essentially the alarm system must be reprogrammed to restore the original settings and information. In any case, this reprogramming requires an installer to return to the site. It can also be appreciated that complete power failure can occur due to a number of different factors. For example, complete power failure occurs when there is a power outage followed by a time duration longer than the life of the backup power source. A further situation could include the inadvertent interruption of power to the system by an installer or the end user for an extended period of time. Both of these situations cause serious inconvenience and require the custom information to be entered into the system.

Perhaps the most critical information stored in the volatile memory is the system time and date information. The time and date is used in combination with other features of the alarm system including scheduling of devices and dating of alarm events which are subsequently reported to the monitoring station. This date and time information can be particularly helpful in analysing alarm events as well as medical emergencies. Some systems report on system activities such as arming and disarming, and the users of the system. As previously described, the control panel often maintains in volatile memory a schedule for programming various features of the alarm system. For example, the schedule could be associated with a timing sequence for turning on various devices associated with the security system. The schedule could be associated authorizing in predetermined time periods certain users allowing these users deactivate the system or to have automatic activation of the system at particular times. Typically, the more sophisticated or customized the alarm system, the more vulnerable the system is to loss of information due to complete power failure.

The present invention seeks to mitigate many of the problems described above.

SUMMARY OF THE PRESENT INVENTION

A security system according to the present invention has a control panel for controlling and communicating with a plurality of sensors and evaluating signals therefrom to determine whether an alarm event has occurred. The control panel includes a telephone out-dial arrangement for reporting alarm events to a remote monitoring station and the panel includes volatile and non-volatile memory for storing system information. A date and time arrangement is associated with the control panel to date stamp any alarm events. The control panel, upon determining an alarm event has occurred, associates the alarm event with a date and time provided by the date and time arrangement and reports the information to the remote monitoring station. The control panel includes a battery backup for temporarily powering the system and maintaining date and time arrangement in the event of a power disruption. The control panel further includes process logic, which in the event of a loss of the date and time information, causes the processing logic to use the out-dial arrangement to complete a communication with the remote monitoring station and receive therefrom date and time information.

According to a further aspect of the invention, the control panel, when in communication with a remote monitoring station receives current date and time information which is compared to the date and time information of the panel and in the event of a discrepancy, the control panel uses the current date and time information.

According to yet a further aspect of the invention, the current date and time information is provided to the control panel as part of a handshake protocol with the remote monitoring station.

In yet a further aspect of the invention, the control panel additionally initiates contact with the remote monitoring station to update the date and time information at predetermined intervals maintained in non-volatile memory.

BRIEF DESCRIPTION OF THE DRAWINGS

Preferred embodiments of the invention are shown in the drawings wherein.

DETAILED DESCRIPTION OF THE PREFERRED EMBODIMENTS

Figure 1:
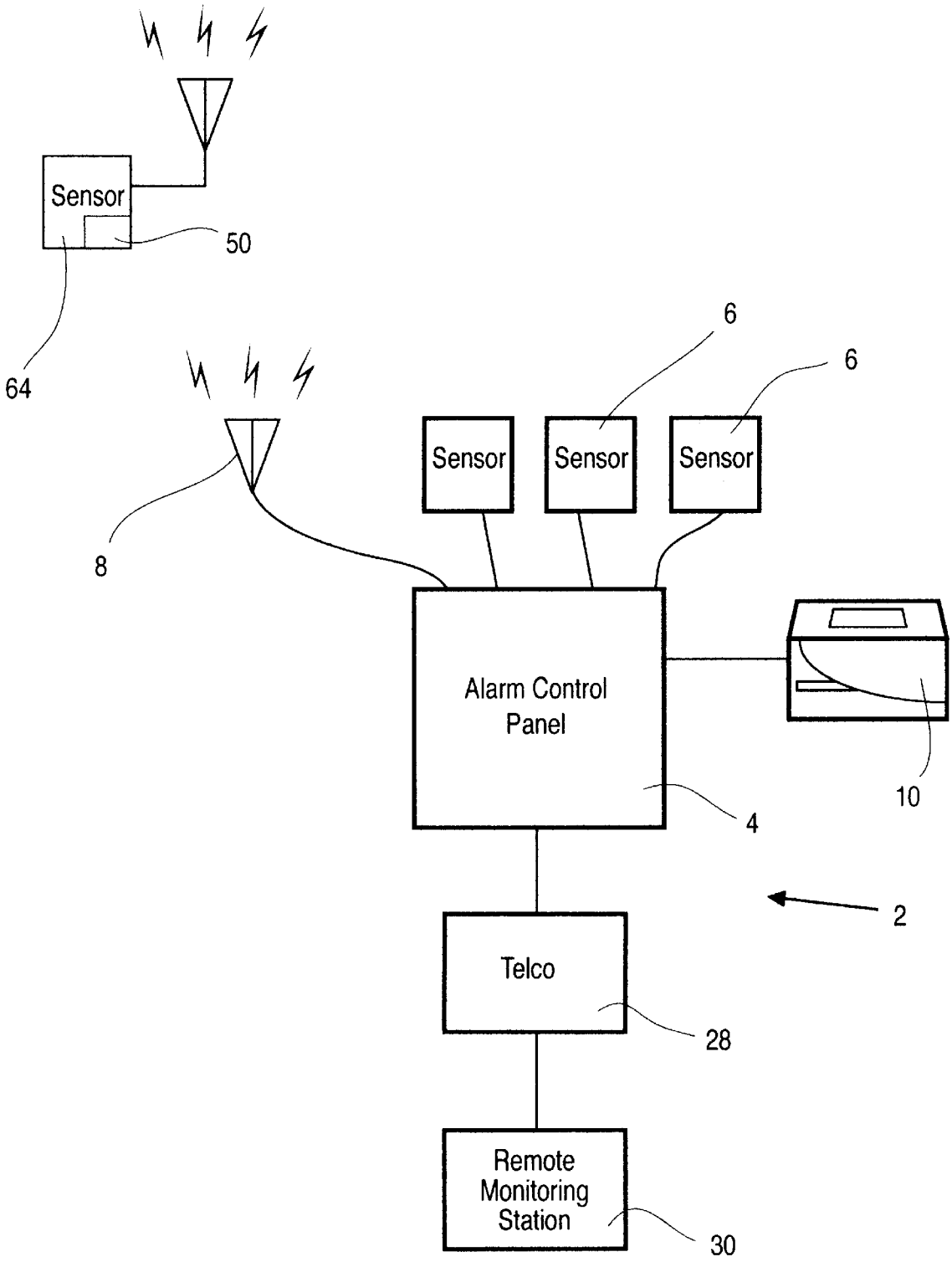
FIG. 1 is a schematic illustrating a conventional alarm system and the major components thereof.

The security system 2 shown in FIG. 1 comprises an alarm control panel 4, which is in communication with a series of sensors 6 which monitor a particular space. The sensors 6 can be hardwired to the alarm control panel and/or the sensors can communicate using RF signals. The alarm panel 4 includes a battery backup source 10. This battery backup provides power to the alarm control panel when the utility power is interrupted. The battery backup is sized for different time durations, however in all cases, it has a fixed and relatively short time duration. The back up power source provides power for the alarm control panel as well as any hardwired sensors and as such, the security system continues to function in the normal manner. The alarm control panel 4 is connected to the telephone network 28 and communicates with the remote monitoring station 30. Alarm events are typically reported to the remote monitoring station and the remote monitoring station contacts the police or appropriate medical personnel, depending upon the reported alarm condition or alarm event.

Figure 2A:
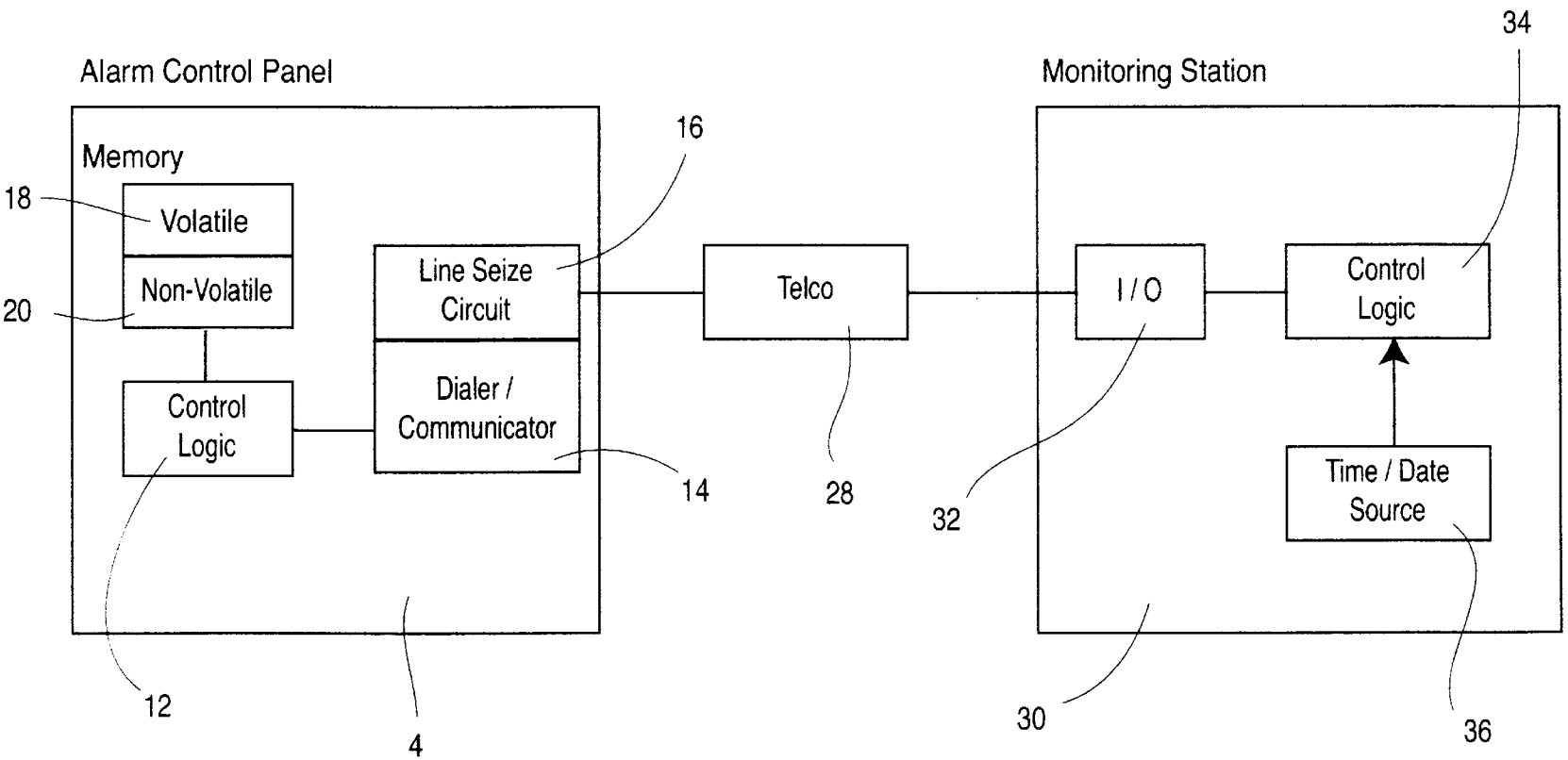
FIG. 2*a* is a block diagram illustrating an alarm system in combination with a remote recovery arrangement.

In FIG. 2*a*, it can be seen that the alarm control panel 4 includes control logic 12 which is connected to the telephone dialer 14 and the line seize circuit 16. This allows the alarm panel to seize the telephone line when necessary for reporting of an alarm event to the monitoring station 30. Basically, the control panel which shares the telephone line with other devices, has priority and can disconnect these other devices when required. The control logic also has associated therewith volatile memory 18 which stores settings and system information that are entered by the installer or the user. This information is generally referred to as site information and is specific to the particular premise. The volatile memory 18 allows the system to be customized for its particular application. The control logic 12 is also associated with the non-volatile memory 20. This non-volatile memory primarily cannot be changed and the majority of the non-volatile memory is set at the factory. It includes default settings for the system in the event that site specific information is lost or not programmed. The monitoring station 30 includes an input/output port 32 connected to the telephone system 28 and also has control logic 34 which has associated therewith time and date information 36. The non-volatile memory 20 includes a portion thereof which can be programmed by the installer. The telephone address of the remote monitoring station is stored in this portion of the non-volatile memory.

Figure 3:
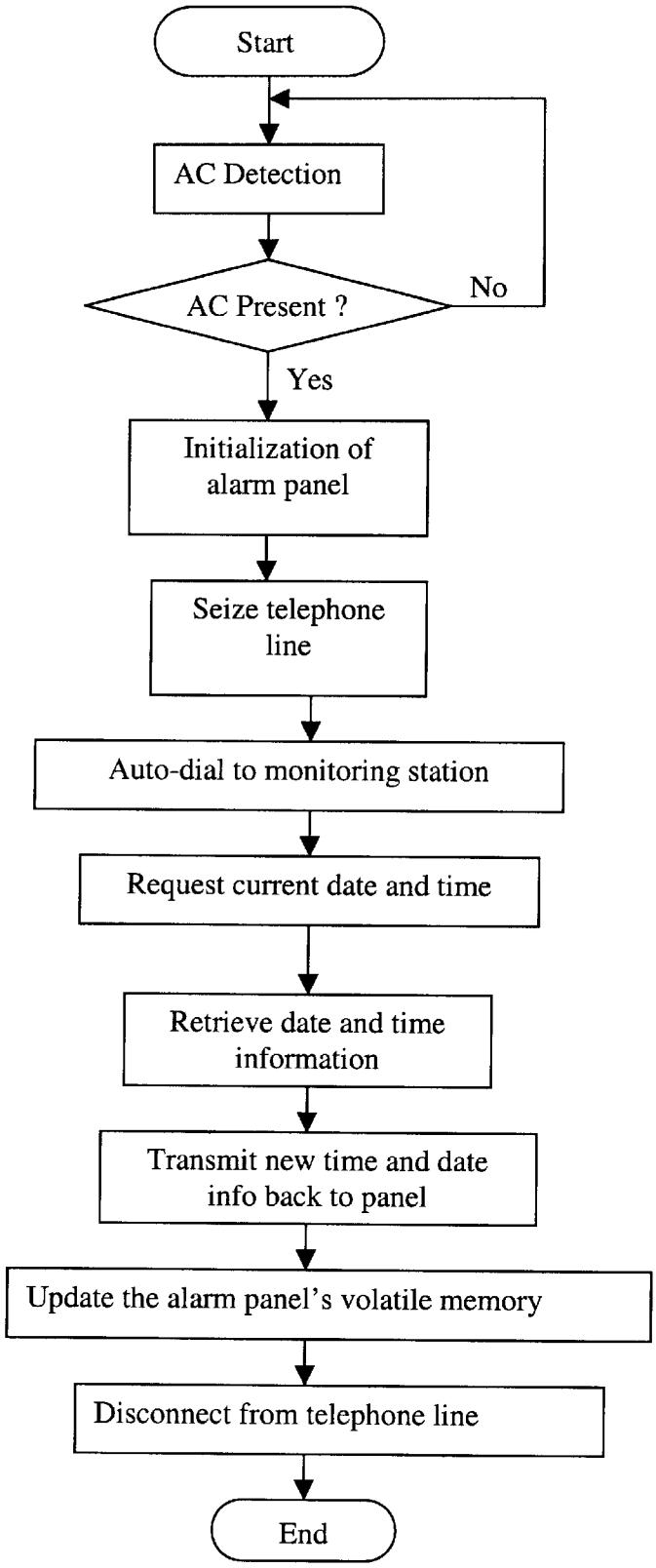
FIG. 3 is a flow diagram showing the logical steps taken to update the alarm control system that has completely lost power and is being restarted.

In the event that complete power is lost to the control panel of FIG. 2*a*, the control logic 12 upon restoration of the power communicates with the monitoring station 30 and obtains at least the current time and date information. This information is used by the alarm control panel to reset the clock automatically and allow the system to date stamp alarm events. This reset procedure is more convenient as the system automatically retrieves the date and time information and there is no requirement for the user to correctly enter the information. The particular logic sequence used by the control panel 4 of FIG. 2*a* is shown in FIG. 3.

Figure 2B:
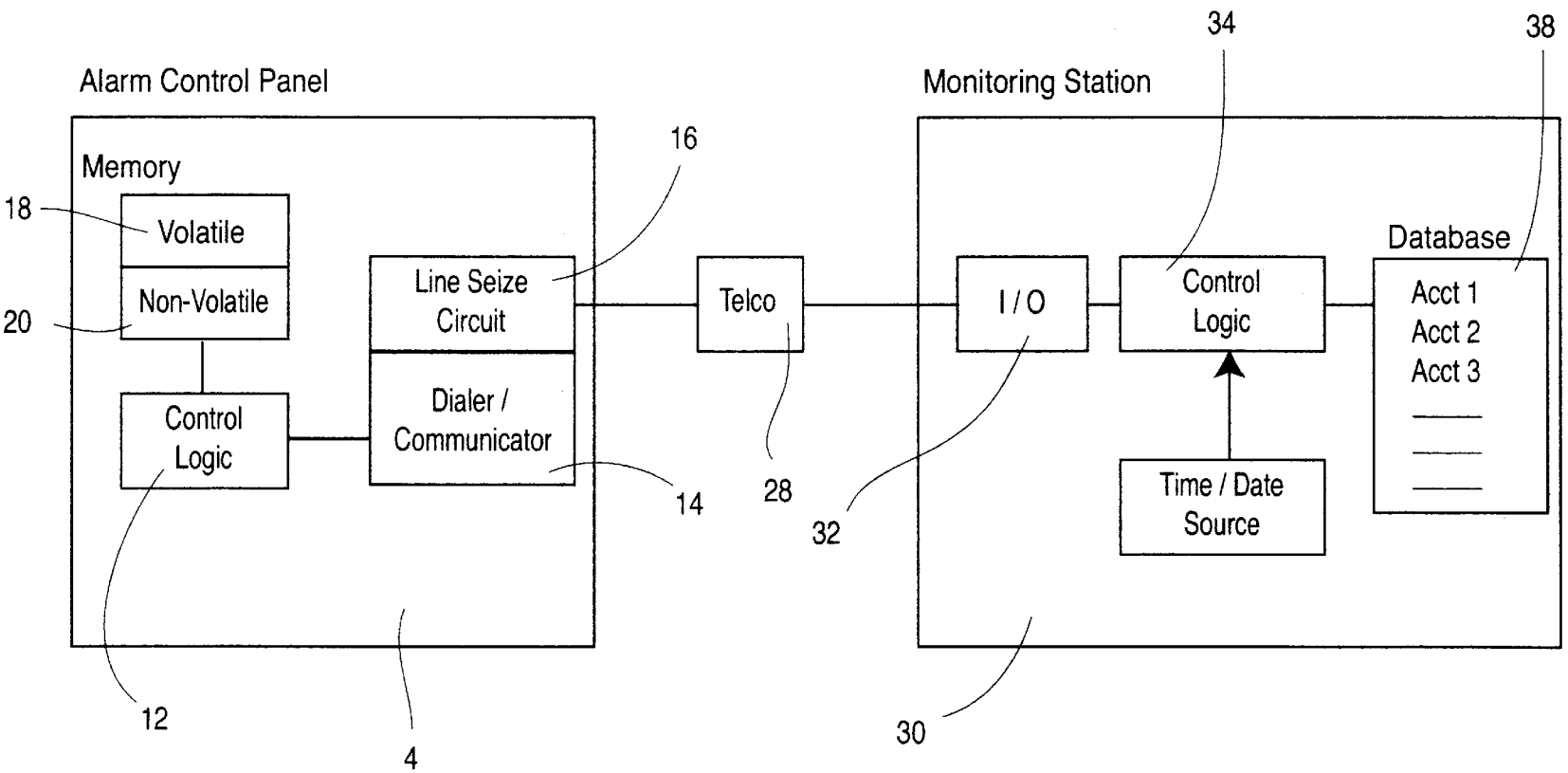
FIG. 2*b* is a block diagram similar to FIG. 2*a* with additional features for recovery of previously stored information.

A preferred embodiment of the invention is shown in FIG. 2*b*. In this case, the alarm control panel 4 additionally retrieves from the remote monitoring station site specific information maintained in the volatile memory 18. For example in addition to the time and date information, the volatile memory 18 could include a schedule of times for turning on and off specific electrical devices associated with the alarm control panel or a schedule associated with authorizing certain codes associated with a specific time period or a schedule associated with the automatic arming or disarming of the alarm control system. As can be appreciated, all of this information is essentially site specific information which is programmed at the time of installation or at a later date, typically by an installer. The alarm control panel 4 during communications with the monitoring station 30 reports the contents of the volatile memory 18 or portions thereof to the monitoring station. The monitoring station stores this information in database 38 associated with the particular unique address associated with the alarm control panel. These are identified in the figure as accounts 1, 2, 3, etc. Therefore, each alarm control panel has a unique personal identification number and the information retained in the volatile memory of the alarm control panel is forwarded to the monitoring station and this information is stored according to the personal identification number.

In the event of a complete power failure of the alarm control panel 4 resulting in loss of information in volatile memory 18, the information is retrieved when power is restored. With the resumption of power, the control logic 12 operates according to a default mode associated with the non-volatile memory 20. This results in the alarm control panel contacting the monitoring station, identifying itself to the monitoring station and requesting the site specific information stored there on its behalf. The monitoring station 30 then retrieves this information according to the PIN and downloads the information to the alarm control panel. This site specific information is stored in the volatile memory and returns the alarm control panel to its previous operating condition. In addition to the site information, the alarm control panel also receives time and date information to allow date stamping and scheduling to be carried out.

Figure 4:
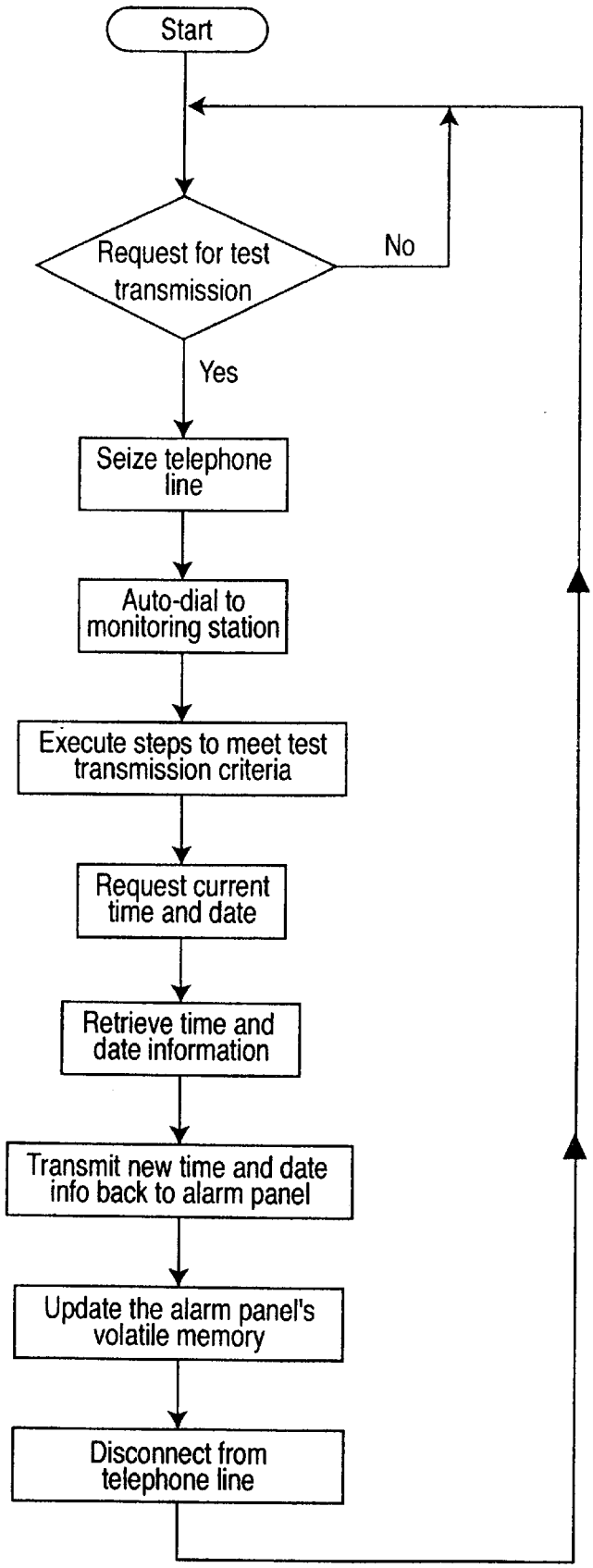
FIG. 4 is a flow diagram showing logic steps of a control panel communicating with a remote recovery arrangement to maintain a more accurate date and time information.

The logic steps for recovering this information from the remote monitoring station is generally set out in FIG. 4. Note that the PIN for the control panel is factory entered in non-volatile memory.

An alternate embodiment of the invention, the alarm control panel system includes a self powered sensor 6*a* such as an RF sensor. This sensor is in communication with the control panel 4 and the communication is a two-way communication. The sensor 6*a* includes a date and time circuit 50. The control panel 4, in the event of a power interruption which causes the control panel to default to the back up power source 10, also causes the control panel to initiate a communication with the sensor 6*a*. This communication includes the current date and time information of the control panel and causes date and time information circuit of the sensor to use the present date and time and start its own date and time circuit. As can be appreciated, the sensor has its own battery source and the draw on this battery source is quite small. Similarly, the power required to maintain the date and time information is also quite small. Thus, during any use of the back up power supply, the date and time information of the control panel is also kept by the sensor. If the backup power supply ultimately fails, then the control panel on resumption of the power instructs the sensor to transmit the date and time information. In this way, the sensor effectively duplicates the date and time function during power interruptions. The power for the sensor will normally outlast the backup power supply which is attempting to maintain the entire alarm system operational. Although this embodiment has been described with respect to an RF sensor, this feature could be included with any device in two-way communication with the control panel which device also has its own power supply.

Although preferred embodiments of the invention have been described herein in detail, it will be appreciated by those skilled in the art that variations may be made thereto without departing from the spirit of the invention or the scope of the appended claims.

The embodiments of the invention in which an exclusive property or privilege is claimed are defined as follows:

1. A security system having a control panel for controlling and communicating with a plurality of sensors and evaluating signals therefrom to determine whether an alarm condition has occurred, said control panel including a telephone out-dial arrangement for reporting alarm events to a remote monitoring station, said control panel including volatile and non-volatile memory and a date and time arrangement; said control panel upon determining an alarm event has occurred associating the alarm event with a date and time provided by said date and time arrangement and reporting said information to the remote monitoring station; said control panel including a battery backup for powering and maintaining said date and time arrangement in the event of a power disruption, said control panel further including processing logic which in the event of a loss of the date and time information said processing logic uses said telephone out-dial arrangement to complete a communication with said remote monitoring station and receive therefrom date and time information.

2. A security system as claimed in claim 1, wherein said control panel provides said remote monitoring station with date and time information and said remote monitoring station compares the provided date and time information with reference date and time information and in the event of a discrepancy, the discrepancy is recorded and the control panel is provided with the reference date and time information.

3. A security system as claimed in claim 1, wherein said control panel, when in communication with said remote monitoring station receives current date and time information which is compared to said date and time information of said panel and in the event of a discrepancy uses the current date and time information.

4. A system as claimed in claim 1, wherein current date and time information is provided to said control panel as part of a handshake protocol with said remote monitoring station.

5. A system as claimed in claim 1, wherein said processing logic additionally initiates a contact with said remote monitoring station to update said date and time information at predetermined intervals.

6. A system as claimed in claim 1, wherein said processing logic additionally initiates a contact with said remote monitoring station and provides said time and date information and other information contained in volatile memory of said control panel to said remote monitoring station, and wherein said remote monitoring station stores said other information for future recall when requested by said control panel.

7. A security system having a control panel for controlling and communicating with a plurality of sensors and evaluating signals therefrom to determine whether an alarm condition has occurred, said control panel including a telephone out-dial arrangement for reporting alarm events to a remote monitoring station, said control panel including volatile and non-volatile memory and a date and time arrangement which maintains a current date and time and other site programmed information in said volatile memory, said control panel during communications with said remote monitoring station transferring thereto for future retrieval said other site programmed information, said control panel upon determining an alarm event has occurred associating the alarm event with a date and time provided by said date and time arrangement and reporting said information to the remote monitoring station, said control panel including a battery backup for maintaining said volatile memory in the event of a power disruption, said control panel further including processing logic for identifying changes in said site programmed information and communicating said changes to said remote monitoring station which updates the site programmed information stored by said remote monitoring station specific to the control panel.

8. A security control system as claimed in claim 7, wherein said processing logic in the event of a power disruption and failure of said battery backup, upon restoration of said power initiates a communication with said remote monitoring station and receives therefrom said site programmed information of said control panel previously communicated to said remote monitoring station.

9. A security control system as claimed in claim 8, wherein said site programmed information includes timing schedules associated with electrical devices controlled by said control panel.

10. A security control system as claimed in claim 9, wherein said control panel during communications with said remote monitoring station receives current time and date information used to reset the time and date information of said control panel.

11. A security control system as claimed in claim 7 including a self powered sensor in two way communication with said control panel; said self powered sensor including a separate date and time arrangement controlled by said control panel, said control panel upon detection of a power interruption communicating current date and time information to said self powered sensor which uses said information to start said separate date and time arrangement, said self powered sensor providing said date and time information to said control panel if requested by said control panel.

12. A security control system as claimed in claim 11 wherein said control panel in the event of a power disruption and failure of said battery back up initiates a communication with said self powered sensor and receives therefrom said date and time information.

* * * * *